US007171014B2

(12) United States Patent
Morales et al.

(10) Patent No.: US 7,171,014 B2
(45) Date of Patent: Jan. 30, 2007

(54) HEARING AID BATTERY DOOR SEAL

(75) Inventors: Nelson Morales, Lakeville, MN (US); Brian L. Fideler, Jordan, MN (US); Mike K. Sacha, Chanhassen, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 453 days.

(21) Appl. No.: 10/284,878

(22) Filed: Oct. 31, 2002

(65) Prior Publication Data

US 2004/0086142 A1 May 6, 2004

(51) Int. Cl.
*H04R 25/00* (2006.01)

(52) U.S. Cl. ..... 381/322; 381/324; 381/328

(58) Field of Classification Search ..... 381/322–324, 381/328; 181/128–130
See application file for complete search history.

(56) References Cited

U.S. PATENT DOCUMENTS

| | | | | |
|---|---|---|---|---|
| 5,675,657 | A * | 10/1997 | Giannetti | 381/328 |
| 5,742,692 | A | 4/1998 | Garcia et al. | 381/68.6 |
| 5,799,095 | A * | 8/1998 | Hanright | 381/312 |
| 6,088,465 | A * | 7/2000 | Hanright et al. | 381/323 |
| 6,144,749 | A * | 11/2000 | Fideler | 381/323 |
| 6,167,141 | A | 12/2000 | Yoest | 381/322 |
| 6,324,291 | B1 | 11/2001 | Weidner | 381/322 |
| 6,678,385 | B2 * | 1/2004 | Olsen | 381/322 |

FOREIGN PATENT DOCUMENTS

| | | |
|---|---|---|
| EP | 704143 | 9/2000 |
| EP | 1082874 | 3/2001 |
| JP | 60261296 | 12/1985 |
| JP | 62008446 | 1/1987 |
| JP | 7203594 | 8/1995 |
| WO | WO-9956501 | 11/1999 |
| WO | WO-20025551 | 5/2000 |

* cited by examiner

*Primary Examiner*—Suhan Ni
(74) *Attorney, Agent, or Firm*—Schwegman, Lundberg, Woessner & Kluth, P.A.

(57) ABSTRACT

A hearing aid having a battery door seal that substantially reduces or eliminates unwanted air flow from and into a battery compartment is provided. Eliminating unwanted air flow removes a potential source of acoustic feedback and provides significant improvement in frequency response of the hearing aid. The hearing aid includes a battery compartment with sidewalls that have a step joint formed between an opening in a faceplate to the battery compartment and a substantially flat portion of the sidewalls. The battery door has a lip that sets on the step joint when the battery door closes providing an air seal around a substantial portion of the battery compartment. A thin slit is provided between the faceplate and the battery door behind the end of the battery door, where the battery door is connected to the faceplate by a hinge to provide appropriate air flow for proper battery operation.

22 Claims, 5 Drawing Sheets

HEARING AID BATTERY DOOR SEAL

FIELD OF THE INVENTION

The invention relates to hearing aid devices. Specifically, the invention relates to a battery compartment of a hearing aid.

BACKGROUND OF THE INVENTION

Hearing aids have a battery compartment for placement of a battery power source for operating the hearing aid. The battery compartment includes a battery door for providing access to the battery compartment to exchange an old battery with a new battery, when the power level of the old battery drops below a useful level.

Unfortunately, the battery door represents a potential reliability problem. Around the battery door are thin openings or gaps. These openings provide an area in which moisture, dirt, and body oils can enter a hearing aid, causing corrosion or intermittent hearing aid behavior. By minimizing these openings into a hearing aid, reliability can greatly be increased. However, a total seal is not desirable. For example, zinc air batteries, the most common hearing aid battery, require air for normal operation.

Another problem associated with a battery door having a poor battery door seal deals with a compromise in acoustic performance of the hearing aid. In particular, in the ear (ITE) hearing aids may allow sufficient sound pressure level (SPL) to leak from the interior of the hearing aid shell through the battery door slit to reach the microphone of the hearing aid. This leakage of acoustic energy to the microphone inlet can result in acoustic feedback, a highly undesirable outcome. Furthermore, these potential reliability problems also accompany battery doors for behind the ear (BTE) hearing aids.

What is needed is a seal around the battery compartment of a hearing aid to eliminate or substantially reduce leakage of acoustic energy that can cause acoustic feedback.

For these and other reasons there is a need for the present invention.

SUMMARY OF THE INVENTION

A solution to the problems as discussed above is addressed in embodiments according to the teachings of the present invention. A hearing aid having a battery door seal that substantially reduces or eliminates unwanted air flow between the inside and outside of the hearing aid through a battery compartment is provided. Eliminating unwanted air flow removes a potential source of acoustic feedback. By eliminating or substantially reducing the unwanted air flow significant improvement is attained in the frequency response of the hearing aid.

Embodiments of a hearing aid include a battery compartment with sidewalls that have a step joint formed between an opening in a faceplate to the battery compartment and a substantially flat portion of the sidewalls of the battery compartment. Additionally, a door to the battery compartment has a lip that sets on a ridge formed by the step joint when the battery door closes, providing an air seal around a substantial portion of the battery compartment. A thin slit is located between the faceplate and the battery door behind the end of the battery door where the battery door is connected to the faceplate by a hinge to provide appropriate air flow for proper battery operation.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims.

DETAILED DESCRIPTION OF THE PREFERRED EMBODIMENTS

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that the embodiments may be combined, or that other embodiments may be utilized and that structural, logical and electrical changes may be made without departing from the spirit and scope of the present invention. The following detailed description is, therefore, not to be taken in a limiting sense, and the scope of the present invention is defined by the appended claims and their equivalents.

Figure 1A:
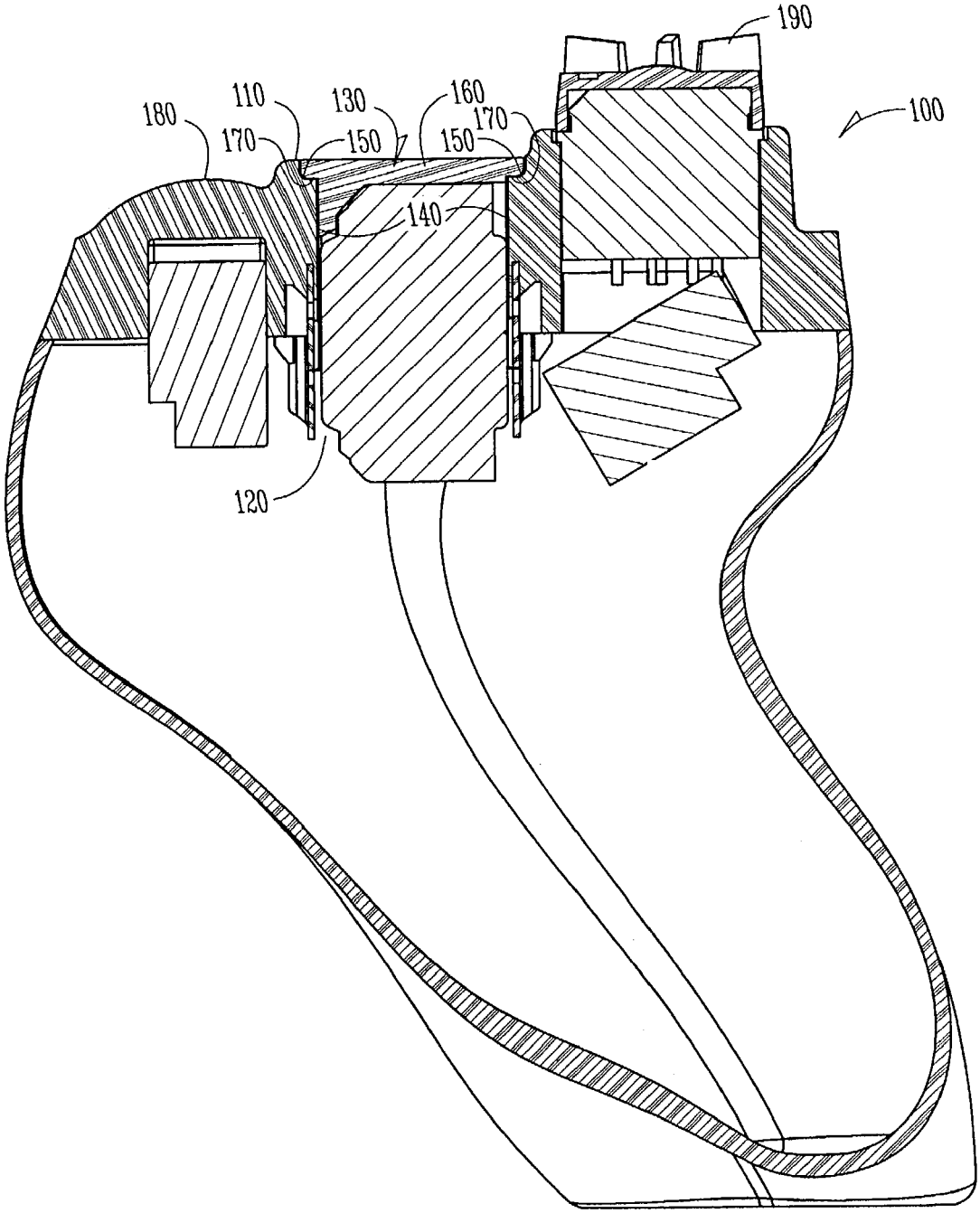
FIG. 1A shows an embodiment of a hearing aid having a faceplate with an opening in the faceplate for a battery compartment closed by a battery door that provides access to the battery compartment, in accordance with the teachings of the present invention.

FIG. 1A shows an embodiment of a hearing aid 100 having a faceplate 110 with an opening in the faceplate 110 for a battery compartment 120 closed by a battery door 130 that provides access to battery compartment 120, in accordance with the teachings of the present invention. Battery compartment 120 has sidewalls, where the sidewalls have a substantially flat port 140 and a step joint 150. The step joint 150, or lap joint 150, is connected to the substantially flat portion 140 and located between the opening in the faceplate 110 and the substantially flat portion 140. The step joint 150 forms a ridge just below the opening in the faceplate 110 for battery compartment 120.

Battery door 130 is coupled to the faceplate 110 by a hinge. Battery door 130 has a body 160 and a lip 170 protruding from the body 160. Lip 170 is adapted to be seated on the ridge formed by the step joint 150 of the sidewalls of battery compartment 120. Lip 170 can have several forms including a step joint (a lap joint). Closing battery door 130 provides an air seal around a substantial portion of battery compartment 120. In one embodiment, the air seal extends around the three sides of battery compartment 120 with a thin slit provided on a fourth side behind the hinge that attaches battery door 130 to the faceplate 110.

In conventional hearing aids, a substantially flat sidewall extends from the opening in a faceplate down into a battery compartment allowing air to flow through a gap between a battery door and the faceplate directly from or into the body of the hearing aid. This air flow, providing acoustic energy flow from inside the hearing aid back to the input to the hearing aid microphone, is a source of unwanted acoustic feedback.

In the embodiments of the present invention, the direct path from inside or outside the hearing aid through battery compartment 120 is reduced. In one embodiment, the seating of lip 170 of battery door 130 into the ridge formed by step joint 150 of the sidewall provides a seal for air flow. This substantially reduces or eliminates acoustic feedback.

Hearing aid 100 includes standard elements as is known by those skilled in the art including a microphone 180 and a volume control 190. Battery compartment 120 is the region of the hearing aid in which a battery is housed. In one embodiment, a battery is held in an arm of battery door 130 and is lowered into battery compartment 120 when battery door 130 is closed.

Figure 1B:
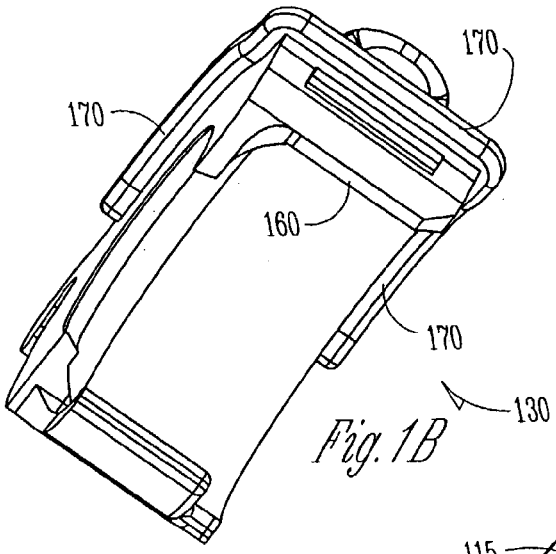
FIG. 1B shows an embodiment of a battery door having a body and a lip protruding from the body, in accordance with the teachings of the present invention.

FIG. 1B shows an embodiment of battery door 130 having body 160 and lip 170 protruding from body 160, in accordance with the teachings of the present invention. Lip 170 of battery door 130 substantially seals air paths between faceplate 110 and battery compartment 120 of FIG. 1A. Lip 170 can have several forms including a lap joint.

Figure 1C:
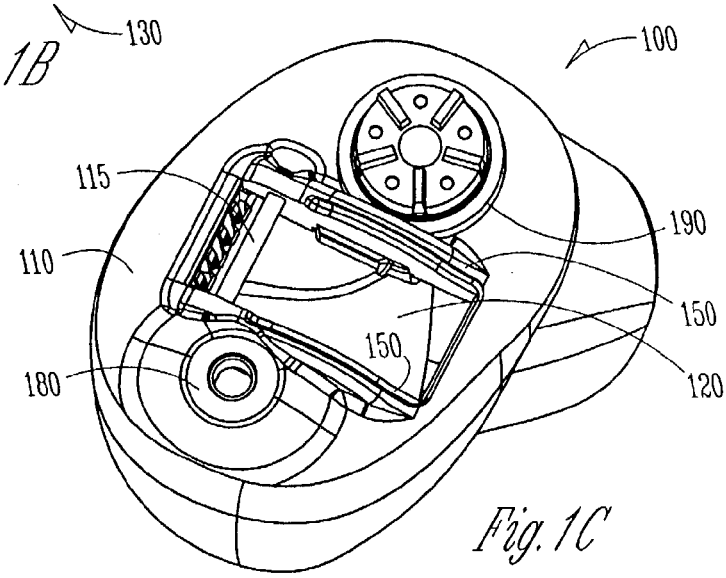
FIG. 1C shows a top view of an embodiment of a hearing aid with its battery door removed, in accordance with the teachings of the present invention.

FIG. 1C shows a top view of an embodiment of hearing aid 100 with battery door 130 removed. This view illustrates step joint 150 of the sidewalls. Step joint 150, or lap joint 150, is one form of a step portion of the sidewalls of a battery compartment that forms a ridge to which a lip of a battery door can be seated upon closing the battery door. The lap joint, or step joint 150, can be formed as part of a plastic molding of the hearing aid.

Battery door 130 of FIG. 1B snaps onto a hinge 115 to fasten battery door 130 to faceplate 110. FIG. 1C also indicates a relative placement of microphone 180 and volume control 190 with respect to battery compartment 120.

Figure 1D:
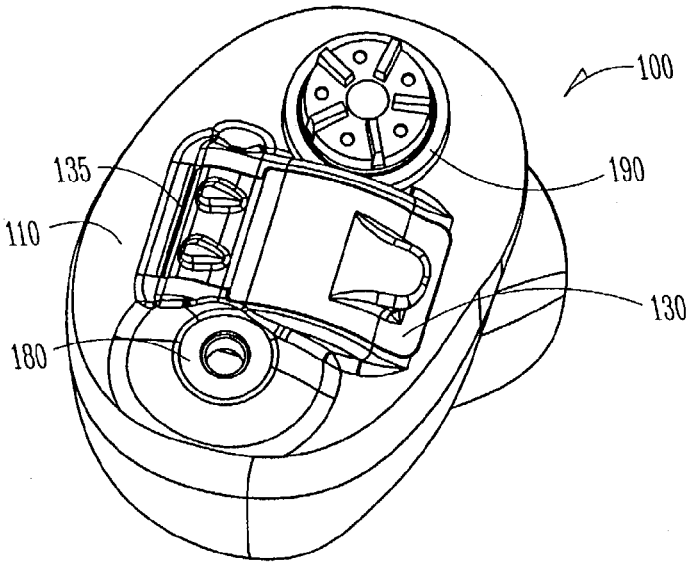
FIG. 1D shows another top view of an embodiment of a hearing aid with a microphone, a volume control, a battery door closed, and a thin slit, in accordance with an embodiment of the teachings of the present invention.

FIG. 1D shows another top view of an embodiment of hearing aid 100 with microphone 180, volume control 190, battery door 130 closed, and a thin slit 135. The thin slit 135 is located at an end of battery door 130 behind a hinge to which battery door 130 is connected. Thin slit 135 allows air into battery compartment 120 of the hearing aid 100 for proper operation of the battery. However, with battery door 130 closed, the sides of battery compartment 120 not adjacent to the thin slit 135 are essentially sealed to air flow from and into battery compartment 120. Thus, with the air flow limited to the thin slit 135, a source of acoustic feedback is greatly reduced, while maintaining proper operation conditions for the hearing aid battery.

Figure 1E:
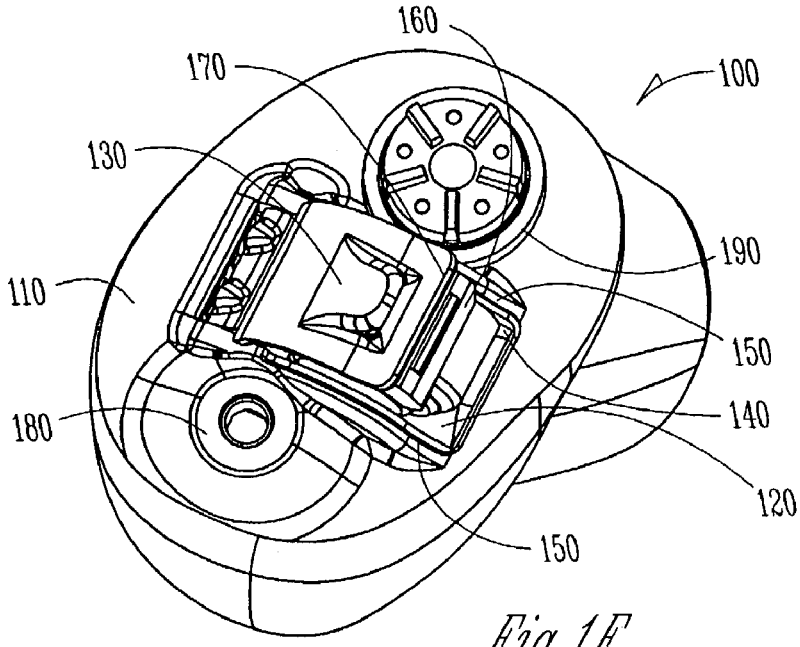
FIG. 1E shows another top view of an embodiment of a hearing aid with a microphone, a volume control, and a partially open battery door attached to a faceplate, in accordance with another embodiment of the teachings of the present invention.

FIG. 1E shows another top view of an embodiment of hearing aid 100 with microphone 180, volume control 190, and partially open battery door 130 attached to faceplate 110. From FIG. 1E, a view is provided demonstrating the seating of lip 170 protruding from body 160 onto the ridge formed by step joint 150 of the sidewalls of battery compartment 120. Also demonstrated is the relationship of the substantially flat portion 140 of the sidewalls to step joint 150 as battery door 130 closes to provide an air seal around a substantial portion of battery compartment 120.

A hearing aid incorporating an embodiment of a battery door seal in accordance with the teachings of the present invention has increased performance relative to a hearing aid without the door seal. For a frequency range from about 3 kHz to about 4 kHz, which is a critical frequency range with respect to the effects of acoustic feedback, the hearing aid incorporating an embodiment of the battery door seal provides approximately a 5 dB improvement in frequency response.

Figure 2:
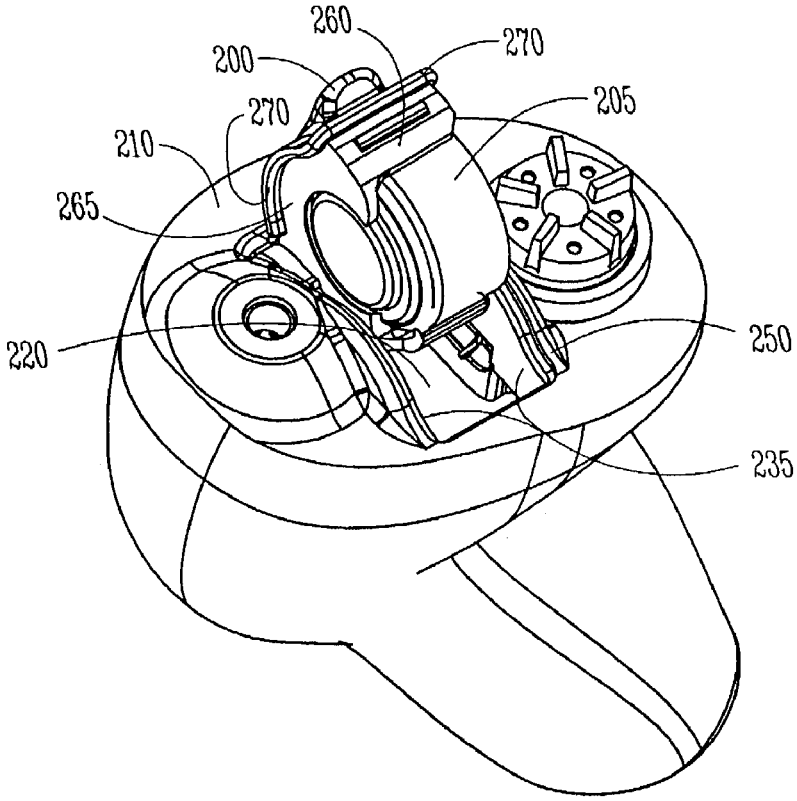
FIG. 2 shows an embodiment of a battery door holding a battery and connected to a faceplate for providing access to a battery compartment, in accordance with the teachings of the present invention.

FIG. 2 shows an embodiment of a battery door 200 holding a battery 205 and connected to a faceplate 210 for providing access to a battery compartment 220. Battery compartment 220 has a gasket 235 affixed to a substantially flat portion of the sidewalls of battery compartment 220. The sidewalls have a step joint 250 located between an opening in faceplate 210 and gasket 235 affixed to a substantially flat portion of the sidewalls.

Battery door 200 has a body 260 and a lip 270 that protrudes from body 260. A second gasket 265 is affixed to sides of body 260. Battery door 200 holds battery 205 and lowers battery 205 into battery compartment 220 as battery door 200 is closed.

When battery door 200 closes, lip 270 seats onto a ridge formed by step joint 250 and forms a seal to air flow into battery compartment 220. Further, with the battery door 200 closed, second gasket 265 presses against gasket 235 to provide a further barrier to air flow from and into barrier compartment 220.

In one embodiment, the gaskets are rubber gaskets. Other materials can be used that can be configured to affix to the substantially flat portion of the sidewalls of the battery compartment and affix to the sides of the battery door body. Alternately, the gaskets can be formed as a two shot mold. A two shot mold consists of molded hard plastic as the base structure with gasket material molded on the hard plastic. For example, battery door 200 is molded as a hard plastic first followed by molding gasketing material 265 on the sides of the door. The two shot mold formation can also be applied to forming the substantially flat sidewalls of the battery compartment 220 with gasket 235.

In one embodiment, battery door 200 is configured to snap onto a hinge connected to faceplate 210. Further a hearing aid to which battery door 200 is connected includes a slit in faceplate 210 located behind the coupling of battery door 200 to the hinge providing an opening to battery compartment 220 for air flow.

Figure 3:
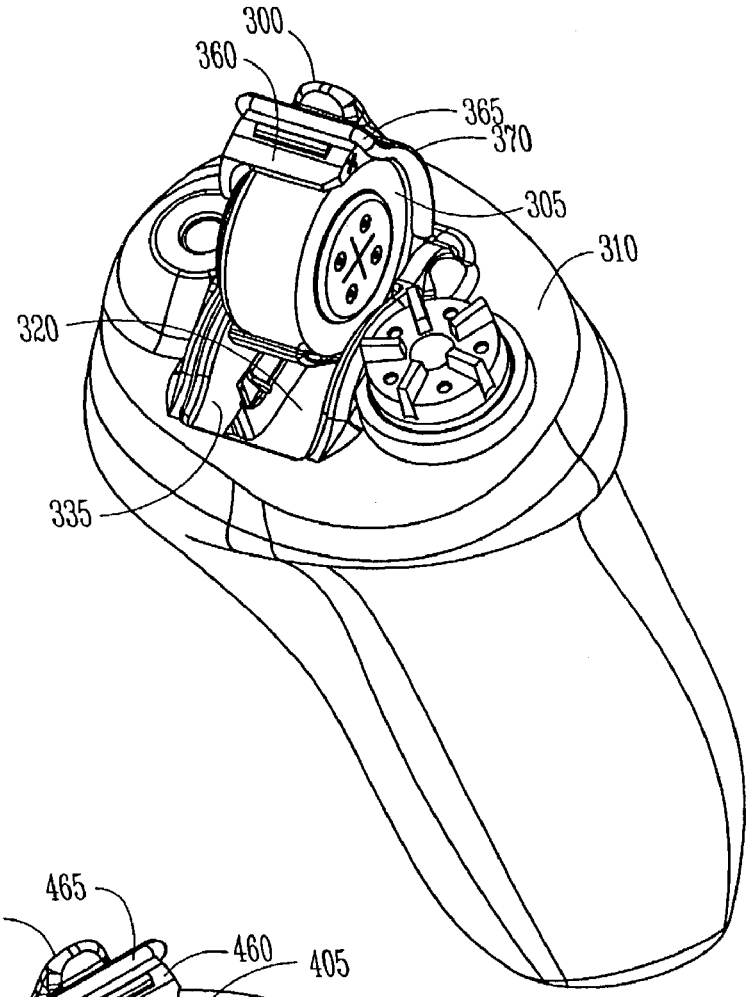
FIG. 3 shows an another embodiment of a battery door holding a battery and connected to a faceplate for providing access to a battery compartment, in accordance with the teachings of the present invention.

FIG. 3 shows an another embodiment of a battery door 300 holding a battery 305 and connected to a faceplate 310 for providing access to a battery compartment 320. Battery compartment 320 has a gasket 335 affixed to a substantially flat portion of the sidewalls of battery compartment 320 and to a step joint located between the opening in the faceplate 310 and the substantially flat portion of the sidewalls.

Battery door 300 has a body 360 and a lip 370 that protrudes from body 360. A second gasket 365 is affixed to lip 370. Second gasket 365 is affixed to lip 370 of battery door 300 such that the second gasket 365 is seated on gasket 335 when the battery door is closed, where gasket 335 covers the step joint of the sidewalls of battery compartment 320. Battery door 300 holds battery 305 and lowers battery 305 into battery compartment 320 as battery door 300 is closed. When battery door 300 closes, gasket 365 of lip 370 seats onto a ridge formed by the step joint covered by gasket 335 and forms a seal to air flow from and into battery compartment 320.

In one embodiment, the gaskets are rubber gaskets. Other materials can be used that can be configured to affix to the substantially flat portion and the step portion of the sidewalls of the battery compartment 320 and affix to lip 370 of the battery door 300.

Alternately, the gaskets can be formed as a two shot mold. For example, battery door 300 is molded as a hard plastic first followed by molding gasketing material 365 onto lip 370. The two shot mold formation can also be applied to forming the substantially flat portion and the step portion of the sidewalls of the battery compartment 320 with gasket 335.

In one embodiment, battery door 300 is configured to snap onto a hinge coupled to faceplate 310. Further a hearing aid to which battery door 300 is connected includes a slit in faceplate 310 located behind the coupling of battery door 300 to the hinge providing an opening to battery compartment 320 for air flow.

Figure 4:
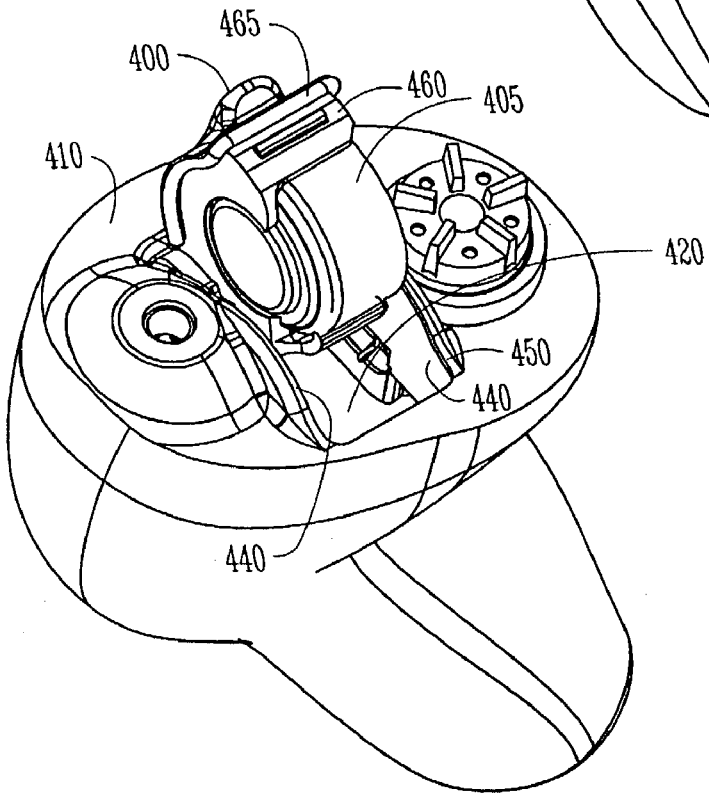
FIG. 4 shows another embodiment of a battery door holding a battery and connected to a faceplate for providing access to a battery compartment, in accordance with the teachings of the present invention.

FIG. 4 shows another embodiment of a battery door 400 holding a battery 405 and connected to a faceplate 410 for providing access to a battery compartment 420. Battery compartment 420 has sidewalls with a substantially flat portion 440 and a step joint 450. Step joint 450 is located between the opening in faceplate 410 and the substantially flat portion 440 of the sidewalls.

Battery door 400 has a body 460 and a gasket 465 disposed on the top portion of battery door 400 with at least a portion of gasket 465 protruding from body 460 of battery door 400 forming a lip. The lip of gasket 465 is adapted to be seated on the ridge formed by step joint 450 of the sidewalls of battery compartment 420 when battery door 400 closes, providing an air seal around a substantial portion of battery compartment 420. Battery door 400 holds battery 405 and lowers battery 405 into battery compartment 420 as battery door 400 is closed. When battery door 400 closes, the lip of gasket 465 seats onto a ridge formed by step joint 450 and forms a seal to air flow from and into battery compartment 420.

In one embodiment, gasket 465 is a rubber gasket. Other materials can be used that can be configured to affix to top of battery door 400 Alternately, the gasket can be formed as a two shot mold. For example, battery door 400 is molded as a hard plastic first followed by molding gasketing material 465 on the top of battery door 400.

In one embodiment, battery door 400 is configured to snap onto a hinge coupled to faceplate 410. Further a hearing aid to which battery door 400 is connected includes a slit in faceplate 410 located behind the coupling of battery door 400 to the hinge providing an opening to battery compartment 420 for air flow.

Figure 5:
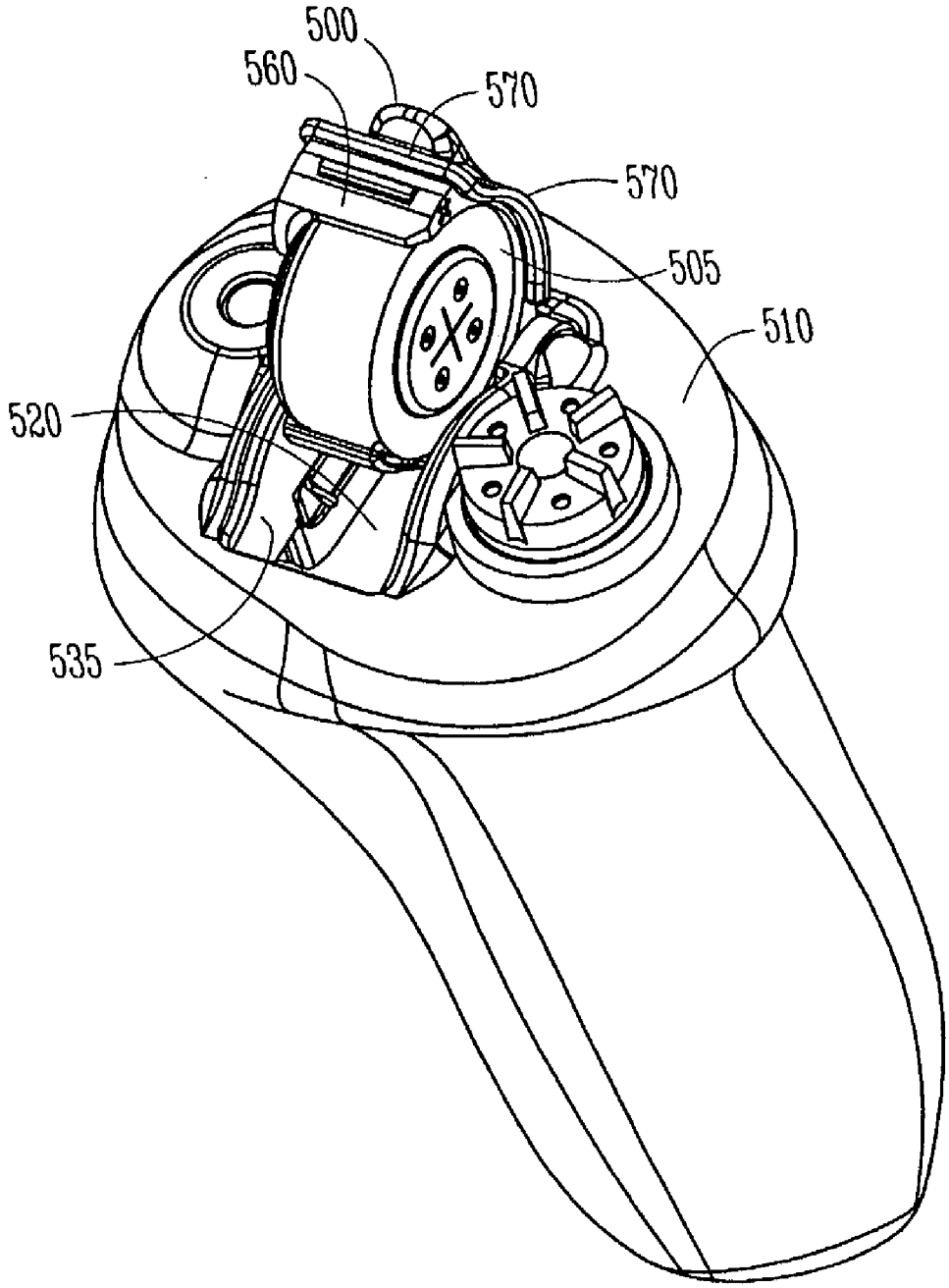
FIG. 5 shows another embodiment of a battery door holding a battery and connected to a faceplate for providing access to a battery compartment, in accordance with an embodiment of the teachings of the present invention.

FIG. 5 shows another embodiment of a battery door 500 holding a battery 505 and connected to a faceplate 510 for providing access to a battery compartment 520. Battery compartment 520 has sidewalls and an opening in the faceplate, where the sidewalls have a substantially flat portion.

A gasket 535 is affixed to the sidewalls of battery compartment 520 . Gasket 535 extends from the opening in faceplate 510 down along at least a portion of the substantially flat portion of the sidewalls. Gasket 535 has a ridge at the opening in the faceplate.

Battery door 500 has a body 560 and a lip 570 that protrudes from body 560. Battery door 500 holds battery 505 and lowers battery 505 into battery compartment 520 as battery door 500 is closed. When battery door 500 closes, lip 570 seats onto the ridge of gasket 535 and forms a seal to air flow from and into battery compartment 520.

In one embodiment, the gasket is a rubber gasket. Other materials can be used that can be configured to affix to the substantially flat portion of the sidewalls of the battery compartment. Alternately, the gasket can be formed as a two shot mold. For example, the substantially flat portion of the sidewalls of battery compartment 520 is molded as a hard plastic first followed by molding gasketing material 535 on the substantially flat portion of the sidewalls.

In one embodiment, battery door 500 is configured to snap onto a hinge coupled to faceplate 510. Further, a hearing aid to which battery door 500 is connected includes a slit in faceplate 510 located behind the coupling of battery door 500 to the hinge providing an opening to battery compartment 520 for air flow.

CONCLUSION

A hearing aid having a battery door seal that substantially reduces or eliminates unwanted air flow from and into a battery compartment of the hearing aid is provided.

Further, the hearing aid having a battery door seal as described in the embodiments herein provide a hearing aid in which moisture, dirt, and body oils are eliminated or substantially reduced increasing reliability and performance of the hearing aid.

Eliminating unwanted air flow removes a potential source of acoustic feedback. By eliminating or substantially reducing the unwanted air flow significant improvement is attained in the frequency response of the hearing aid. However, a complete seal that eliminates all air flow does not provide air needed for proper operation of some common batteries.

Embodiments of a hearing aid include a battery compartment with sidewalls that have a step joint, or lap joint, formed between an opening in a faceplate to the battery compartment and a substantially flat portion of the sidewalls of the battery compartment. The step joint is one form for a step portion of the sidewalls to form a ridge in the sidewalls located at the opening in the faceplate. Additionally, a door to the battery compartment has a lip that seats on a ridge formed by the step joint when the battery door closes providing an air seal around a substantial portion of the battery compartment. One embodiment of the lip includes a step joint formed in the battery door. A thin slit is provided between the faceplate and the battery door behind the end of the battery door where the battery door is coupled to the faceplate by a hinge.

Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. It is to be understood that the above description is intended to be illustrative, and not restrictive. Combinations of the above embodiments, and other embodiments will be apparent to those of skill in the art upon reviewing the above description. The scope of the invention includes any other applications in which the above structures and fabrication methods are used. The scope of the invention should be determined with reference to the appended claims, along with the full scope of equivalents to which such claims are entitled.

What is claimed is:

1. A hearing aid comprising:

a faceplate;

a battery compartment having sidewalls and an opening in the faceplate, the sidewalls having a substantially flat portion and a step portion connected to the substantially flat portion, the step portion located between the opening in the faceplate and the substantially flat portion, the step portion forming a ridge; and a battery door coupled to the faceplate by a hinge, the battery door having a body and a lip protruding from the body, wherein the lip is adapted to be seated on the ridge formed by the step portion on three sides of the battery compartment when the battery door is in a closed position to provide an air seal around a substantial portion of the battery compartment.

2. The hearing aid of claim 1, wherein the battery door is configured to snap onto hinge connected to the faceplate.

3. The hearing aid of claim 1, wherein the hearing aid further includes a slit in the faceplate located at an end of the battery door behind the hinge, the slit providing an opening to the battery compartment for air flow.

4. The hearing aid of claim 1, wherein the faceplate, the battery compartment, and the battery door are plastic.

5. A hearing aid comprising:

a faceplate;

a battery compartment having sidewalls and an opening in the faceplate, the sidewalls having a substantially flat portion and a step portion connected to the substantially flat portion, the step portion located between the opening in the faceplate and the substantially flat portion, the step portion forming a ridge; and a battery door coupled to the faceplate by a hinge, the battery door having a body and a lip protruding from the body, wherein the lip is adapted to be seated on the ridge formed by the step portion when the battery door is closed providing an air seal around a substantial portion of the battery compartment, wherein the hearing aid further includes a first gasket affixed to the substantially flat portion of the sidewalls and a second gasket affixed to sides of the body of the battery door, the sides of the battery door body substantially parallel to the substantially flat portion of the sidewalls when the battery door is closed.

6. The hearing aid of claim 5, wherein the first gasket and the second gasket are rubber gaskets.

7. The hearing aid of claim 5, wherein the first gasket affixed to the substantially flat portion of the sidewalls includes the substantially flat portion of the sidewalls molded of hard plastic with the first gasket molded on the hard plastic of the substantially flat portion of the sidewalls, and the second gasket affixed to sides of the body of the battery door includes the battery door molded of hard plastic with the second gasket molded on the hard plastic of the sides of the battery door body.

8. The hearing aid of claim 5, wherein the hearing aid further includes a slit in the faceplate located at an end of the battery door behind the hinge, the slit providing an opening to the battery compartment for air flow.

9. A hearing aid comprising:

a faceplate;

a battery compartment having sidewalls and an opening in the faceplate, the sidewalls having a substantially flat portion and a step portion connected to the substantially flat portion, the step portion located between the opening in the faceplate and the substantially flat portion, the step portion forming a ridge; and a battery door coupled to the faceplate by a hinge, the battery door having a body and a lip protruding from the body, wherein the lip is adapted to be seated on the ridge formed by the step portion when the battery door is closed providing an air seal round a substantial portion of the battery compartment, wherein the hearing aid further includes a first gasket affixed both to the substantially flat portion and the step portion of the sidewalls and a second gasket affixed to the lip of the battery door such that the second gasket is seated on the first gasket affixed to the step portion when the battery door is closed.

10. The hearing aid of claim 9, wherein the first gasket and the second gasket are rubber gaskets.

11. The hearing aid of claim 9, wherein the first gasket affixed both to the substantially flat portion and the step portion of the sidewalls includes both the substantially flat portion and the step portion of the sidewalls molded of hard plastic with the first gasket molded on the hard plastic of both the substantially flat portion and the step portion of the sidewalls, and the second gasket affixed to the lip of the battery door includes the lip of the door molded of hard plastic with the second gasket molded on the hard plastic of the lip of the battery door.

12. The hearing aid of claim 9, wherein the hearing aid further includes a slit in the faceplate located at an end of the battery door behind the hinge, the slit providing an opening to the battery compartment for air flow.

13. A hearing aid comprising:

a faceplate;

a battery compartment having sidewalls and an opening in the faceplate, the sidewalls having a substantially flat portion and a step portion connected to the substantially flat portion, the step portion located between the opening in the faceplate and the substantially flat portion, the step portion forming a ridge;

a battery door coupled to the faceplate by a hinge, the battery door having a body and a top portion; and a gasket disposed on the top portion of the battery door with at least a portion of the gasket protruding from the body of the battery door forming a lip, wherein the lip of the gasket is adapted to be seated on a ridge formed by the step portion when the battery door is closed providing an air seal around a substantial portion of the battery compartment.

14. The hearing aid of claim 13, wherein the battery door is configured to snap onto hinge connected to the faceplate.

15. The hearing aid of claim 13, wherein the gasket is a rubber gasket.

16. The hearing aid of claim 13 wherein the gasket disposed on the top portion of the battery door includes the battery door molded of hard plastic with the gasket molded on the hard plastic of the top portion of the battery door.

17. The hearing aid of claim 13, wherein the hearing aid further includes a slit in the faceplate located at an end of the battery door behind the hinge, the slit providing an opening to the battery compartment for air flow.

18. A hearing aid comprising:

a faceplate;

a battery compartment having sidewalls and an opening in the faceplate, the sidewalls having a substantially flat portion;

a gasket affixed to the sidewalls, the gasket extending from the opening in the faceplate down along at least a portion of the substantially flat portion of the sidewalls, the gasket having a ridge at the opening in the faceplate; and a battery door coupled to the faceplate by a hinge, the battery door having a body and a lip protruding from the body, wherein the lip is adapted to be seated on the ridge of the gasket when the battery door is closed providing an air seal around a substantial portion of the battery compartment.

19. The hearing aid of claim 18, wherein the battery door is configured to snap onto hinge connected to the faceplate.

20. The hearing aid of claim 18, wherein the gasket is a rubber gasket.

21. The hearing aid of claim 18, wherein the gasket affixed to the sidewalls includes the sidewalls molded of hard plastic with the gasket molded on the hard plastic of the sidewalls.

22. The hearing aid of claim 18, wherein the hearing aid further includes a slit in the faceplate located behind the coupling of the battery door to the hinge providing an opening to the battery compartment for air flow.

* * * * *

UNITED STATES PATENT AND TRADEMARK OFFICE

CERTIFICATE OF CORRECTION

PATENT NO. : 7,171,014 B2
APPLICATION NO. : 10/284878
DATED : January 30, 2007
INVENTOR(S) : Morales et al.

It is certified that error appears in the above-identified patent and that said Letters Patent is hereby corrected as shown below:

In column 8, line 15, in Claim 9, delete “round” and insert -- around --, therefor.

Signed and Sealed this

Tenth Day of April, 2007

JON W. DUDAS
*Director of the United States Patent and Trademark Office*